US007628388B2

(12) United States Patent
Egawa

(10) Patent No.: US 7,628,388 B2
(45) Date of Patent: Dec. 8, 2009

(54) POSTPROCESSING APPARATUS AND IMAGE FORMING SYSTEM

(75) Inventor: Keisuke Egawa, Osaka (JP)

(73) Assignee: Kyocera Mita Corporation (JP)

( * ) Notice: Subject to any disclaimer, the term of this patent is extended or adjusted under 35 U.S.C. 154(b) by 431 days.

(21) Appl. No.: 11/598,290

(22) Filed: Nov. 13, 2006

(65) Prior Publication Data

US 2007/0108688 A1 May 17, 2007

(30) Foreign Application Priority Data

Nov. 15, 2005 (JP) ..... 2005-330274

(51) Int. Cl.
*B65H 37/04* (2006.01)

(52) U.S. Cl. ..... 270/37; 270/20.1; 270/32; 270/45; 270/51; 270/58.01; 270/58.07; 270/58.08; 270/58.09

(58) Field of Classification Search ..... 270/20.1, 270/32, 37, 45, 51, 58.01, 58.07, 58.08, 58.09; 412/6, 18, 25, 33

See application file for complete search history.

(56) References Cited

U.S. PATENT DOCUMENTS 4,046,366 A * 9/1977 McCain et al. ..... 270/21.1
5,377,965 A * 1/1995 Mandel et al. ..... 270/37
6,793,210 B2 * 9/2004 Sato ..... 270/37

FOREIGN PATENT DOCUMENTS

| | | |
|---|---|---|
| JP | 2000-143088 | 5/2000 |
| JP | 2002-284431 | 10/2002 |
| JP | 2004-99274 | 4/2004 |

* cited by examiner

*Primary Examiner*—Gene Crawford
*Assistant Examiner*—Leslie A Nicholson, III
(74) *Attorney, Agent, or Firm*—Gerald E. Hespos; Anthony J. Casella

(57) ABSTRACT

A postprocessing apparatus includes: a housing to which a recording sheet is fed from a predetermined upstream device; a first postprocessing mechanism mounted in the housing and adapted for performing a predetermined first postprocessing to the recording sheet; a second postprocessing mechanism selectively mountable in the housing, and is provided with a predetermined driver, the second postprocessing mechanism being adapted for performing a predetermined second postprocessing to the recording sheet; a conveyance passage provided in the first postprocessing mechanism and adapted for conveying the recording sheet to the second postprocessing mechanism when the second postprocessing mechanism is mounted in the housing; and a conveying member provided in the conveyance passage and adapted for conveying the recording sheet. The conveying member is driven by a transmission of a driving force from the driver of the second postprocessing mechanism.

14 Claims, 5 Drawing Sheets

10a(10)
16
114
15
14
13
41
V
31
310
311
30
40
20
33
38
12
341
343
342
34

+Y
+X
-X
-Y
10a(10)
16
114
15
14
13
41
31
310
115
311
30
40
20
33
38
12
113
112
111
11

POSTPROCESSING APPARATUS AND IMAGE FORMING SYSTEM

BACKGROUND OF THE INVENTION

1. Field of the Invention

The present invention relates to a postprocessing apparatus for performing a predetermined postprocessing to a recording sheet to which a predetermined processing is performed preliminarily in an upstream device such as an image forming apparatus and discharging the recording sheet, and an image forming system adopting the same.

2. Description of the Related Art

Conventionally, an apparatus for performing a postprocessing to a recording sheet as described in Japanese Patent Publication No. 2004-99274 has been known. The postprocessing apparatus receives a recording sheet to which an image forming processing is performed in an upstream device including an image forming apparatus, performs a postprocessing such as a punching processing and a stapling processing to the recording sheet and then discharges the recording sheet. The stapling processing of binding a plurality of received recording sheets with a binding needle is performed in a stapling unit which is detachably mounted in a main body (housing) of the apparatus.

The stapling unit includes a receiving side unit provided at a slant in the main body and a cover unit covered on an upper surface of the receiving side unit. A plurality of recording sheets are aligned and stored in a gap (processing space) between the units. Accordingly, a stack of recording sheet is formed. A stapler is integrally provided between the units, and the stapling processing is performed to the stack of recording sheets by a predetermined operation of the stapler. The stack of recording sheets after the stapling processing performed thereto is completed is discharged from the processing space between the units to an outer portion.

To position the recording sheets led into the processing space at a predetermined position and discharge the stack of recording sheets after the stapling processing thereto is completed, the receiving side unit is provided with an endless belt which is positioned so as to surround the receiving side unit and revolves around the rollers provided in upper and lower portions of the receiving side unit. Further, a sheet receiving member for receiving the recording sheet on the endless belt and supporting the same is provided projectingly. Then, the stack of recording sheets formed in the processing space is conveyed or positioned at a determined position in the processing space by the sheet receiving member moved or stopped in accordance with a revolving of the endless belt.

In a lower portion of the stapling unit in the main body, a center-folding unit is provided. The center-folding unit is a unit for bending the stack of recording sheets to which the stapling processing is performed at a central portion in a longitudinal direction of the recording sheet such that the stapled recording sheets bend along a position at which the stapling processing is performed. Namely, the center-folding unit is a unit for performing a bending processing. The center-folding unit performs the bending processing to the stack of recording sheets by pressing the stapled position of the stack of recording sheets toward a nipping portion of a pair of center-folding rollers with a plate-like pressing member.

On the side of the center-folding unit at a boundary position between the stapling unit and the center-folding unit, a pair of conveying rollers for conveying the stack of recording sheets which is to be bent after the stapling processing to the bending position of the center-folding unit is provided. The stack of recording sheets which is to be bent is conveyed smoothly from the stapling unit to the bending position of the center-folding unit by a driving of the pair of conveying rollers. The stack of recording sheets after the center-folding processing is performed pass through the pair of center-folding rollers and is discharged to a discharging tray exclusively used for the center-folding processing.

In the postprocessing apparatus described in the patent document, the stapler is provided in the stapling unit which is so constructed as to be detachable with respect to the main body. However, if the stapler, which is such a heavy-load item having a complex structure, is provided on the side of the stapling unit, the stapling unit may become heavier and have a complex structure, or may become so heavy that attaching and detaching operation of the stapling unit involves a difficulty.

To resolve such disadvantages, a stapler-separation type postprocessing apparatus has been recently proposed and practically used. In the stapler-separation type postprocessing apparatus, the stapler is mounted in the side of the main body of the apparatus. The stack of recording sheets are aligned in the processing space in the stapling unit and conveyed to the stapler by a movement of the sheet receiving member with a revolving of the endless belt. Then, the stapling processing is performed to the stack of recording sheets.

In the stapler-separation type postprocessing apparatus, the stapler is provided in a lower end portion of the stapling unit. Therefore, it is necessary to provide an alternative route which detours the stapler for conveyance of the recording sheet to which the center-folding processing is performed in the stapling unit to the center-folding unit. Since the alternative route is liable to have such a long length, it is necessary to provide a conveyer also in the alternative route for conveying the stack of recording sheets to the center-folding unit.

Meanwhile, it is less often to perform the center-folding processing to the stack of recording sheets in the postprocessing apparatus, and many users do not require the center-folding unit. On the other hand, there exist users who need the center-folding unit. To meet the contradicting needs of users, it can be considered to construct the postprocessing apparatus to have a fundamental structure including only the stapling unit, and the center-folding unit may be selectively mounted in accordance with needs of users.

In the postprocessing apparatus which is so constructed that the center-folding unit is selectively mountable to the one having a fundamental structure of the stapler separation type, the conveyer for conveying the stack of recording sheets to the center-folding unit is provided in the alternative route to detour the stapler as described above. If the postprocessing unit is so constructed that a driving force is transmitted from a driver mounted on the side of the stapling unit to the conveyer through a driving force transmission mechanism, a problem arises in which the cost is caused to increase even when the center-folding unit is not mounted in the postprocessing apparatus. Meanwhile, since the center-folding unit is integrally mounted in the main body by default in the postprocessing apparatus disclosed in the Japanese patent Publication No. 2004-99274, it is not susceptible to cause such problem as described above.

SUMMARY OF THE INVENTION

According to the instance described above, with regard to the conveying mechanism provided on the side of the stapling unit in the postprocessing apparatus for conveying the stack of recording sheets to the center-folding unit, an object of the present invention is to avoid using a driver on the side of the stapling unit to simplify a structure of the housing on the side of the stapling unit.

A postprocessing apparatus according to one aspect of the present invention for achieving the object comprises: a housing to which a recording sheet is fed from a predetermined upstream device; a first postprocessing mechanism mounted in the housing and adapted for performing a predetermined first postprocessing to the recording sheet; a second postprocessing mechanism selectively mountable in the housing, and is provided with a predetermined driver, the second postprocessing mechanism being adapted for performing a predetermined second postprocessing to the recording sheet; a conveyance passage provided in the first postprocessing mechanism and adapted for conveying the recording sheet to the second postprocessing mechanism when the second postprocessing mechanism is mounted in the housing; and a conveying member provided in the conveyance passage and adapted for conveying the recording sheet, the conveying member being driven by a transmission of a driving force from the driver of the second postprocessing mechanism.

An image forming system according to other aspect of the present invention for achieving the above-described object comprises: the image forming apparatus for performing an image forming processing with respect to the recording sheet; and the postprocessing apparatus provided on downstream in the sheet conveyance direction with respect to the image forming apparatus and adapted for performing a predetermined postprocessing with respect to the recording sheet conveyed from the image forming apparatus, the postprocessing apparatus including: the housing including a reception opening for receiving a recording sheet which is fed from the image forming apparatus; the first postprocessing mechanism mounted in the housing and adapted for performing the predetermined first postprocessing to the recording sheet; the second postprocessing mechanism selectively mountable in the housing and including the predetermined driver, the second postprocessing mechanism being adapted for performing the predetermined second postprocessing to the recording sheet; the conveyance passage provided in the first postprocessing mechanism and adapted for conveying the recording sheet to the second postprocessing mechanism when the second postprocessing mechanism is mounted in the housing; and the conveying member provided in the conveyance passage and adapted for conveying the recording sheet, the conveying member being driven by a transmission of a driving force from the driver of the second postprocessing mechanism.

These and other objects, features, aspects, and advantages of the present invention will become more apparent from the following detailed description of the preferred embodiments/examples with reference to the accompanying drawings.

BRIEF DESCRIPTION OF THE DRAWING

FIG. 1A shows the state where a stapling unit is mounted in the housing, and FIG. 1B shows the state where the stapling unit is pulled out of the housing.

FIG. 5A shows a state just before the center-folding unit is connected to a basic postprocessing apparatus. FIG. 5B shows the state where the center-folding unit is connected to the basic postprocessing apparatus.

DETAILED DESCRIPTION OF THE PREFERRED EMBODIMENTS

Hereinafter, an embodiment of the present invention is described with reference to the drawings.

Figure 1B:
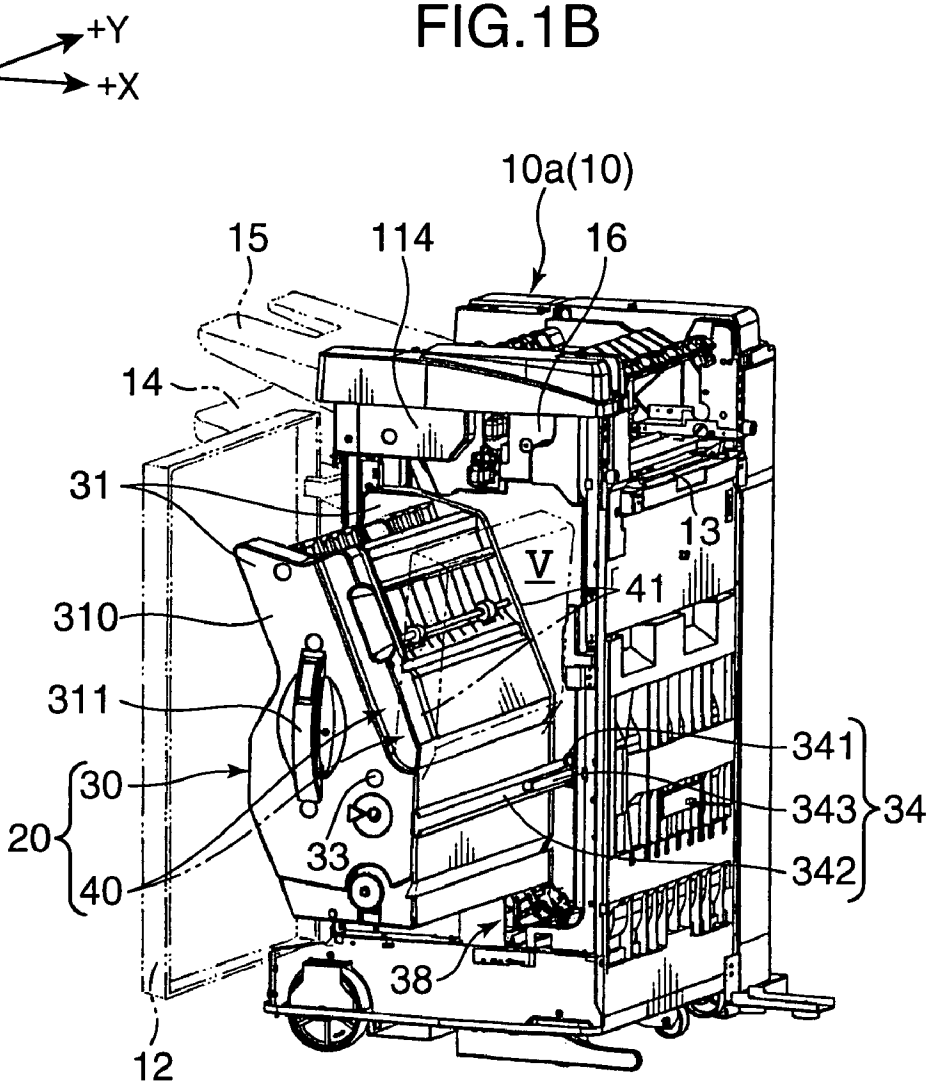
FIGS. 1A, 1B are exterior perspective views of an embodiment of a postprocessing apparatus according the present invention in the state where an exterior plate is detached and a center-folding unit is not mounted in a housing selectively. Especially.
Figure 1A:
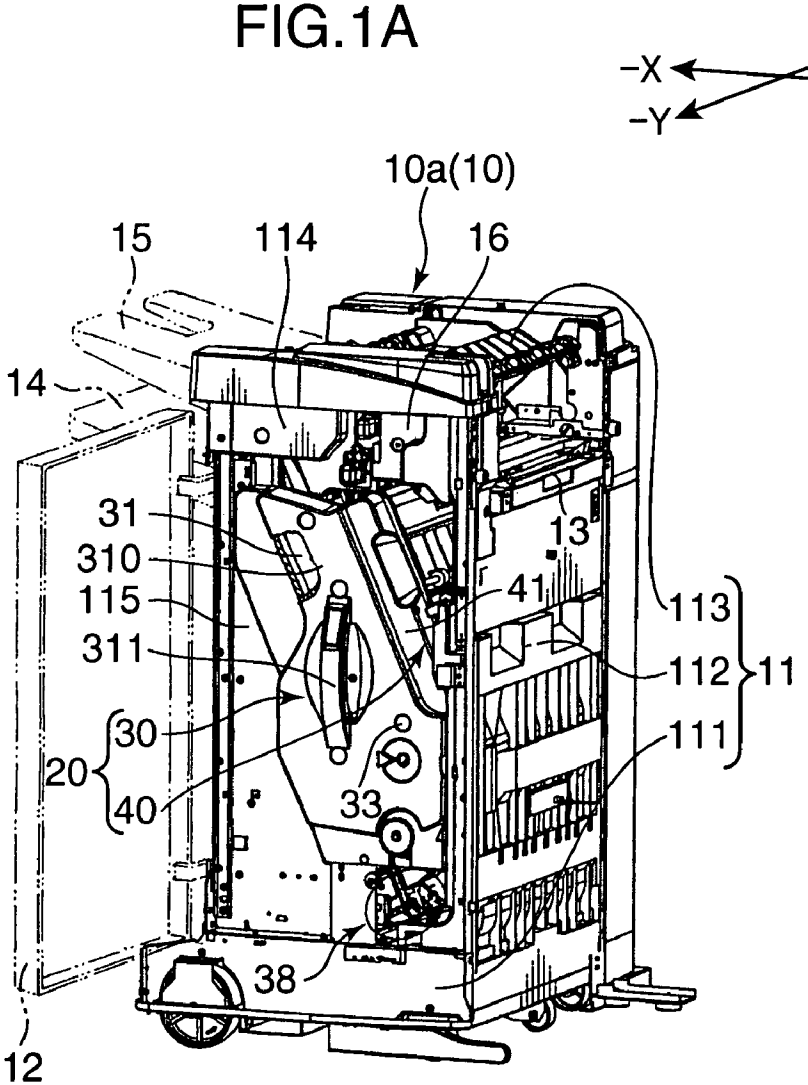
Figure 2:
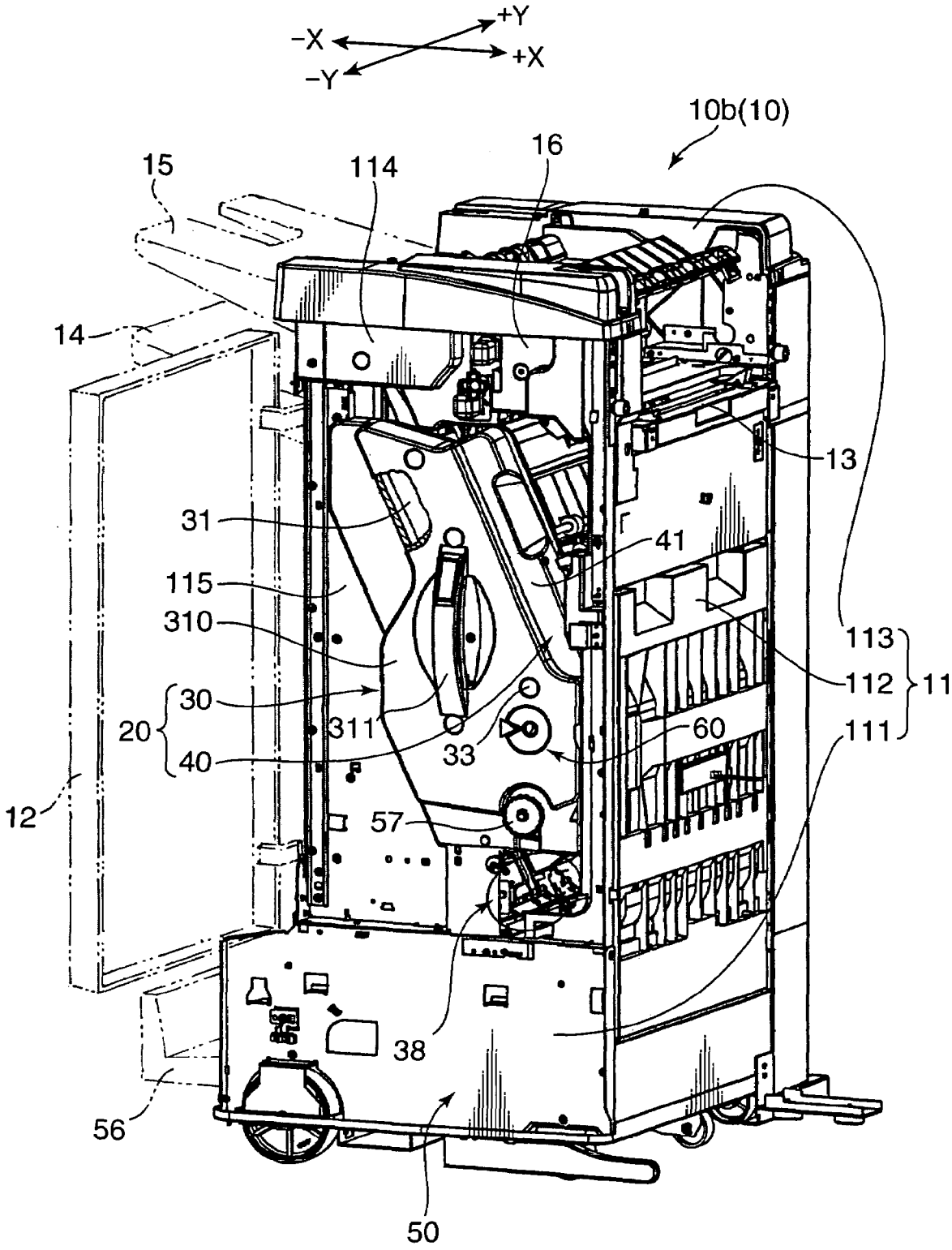
FIG. 2 is a perspective view showing the state where the center-folding unit is selectively mounted in the postprocessing apparatus shown in FIGS. 1A, 1B.

FIGS. 1A, 1B and 2 are external perspective views of an embodiment of a postprocessing apparatus 10 according to the present invention showing the state where an external plate is detached. FIGS. 1A, 1B show the state where a center-folding unit 50 is not mounted in a housing 11 selectively. FIG. 2 shows the state where the center-folding unit 50 is mounted in the housing 11. Especially, FIG. 1A shows the state where a stapling unit 20 is stored in the housing 11, and the FIG. 1B shows the state where the stapling unit 20 is pulled out of the housing 11. Further, FIG. 3 is a front sectional explanatory diagram schematically showing the embodiment of an internal structure of the postprocessing apparatus 10 in the state where the center-folding unit 50 is mounted thereon.

Figure 3:
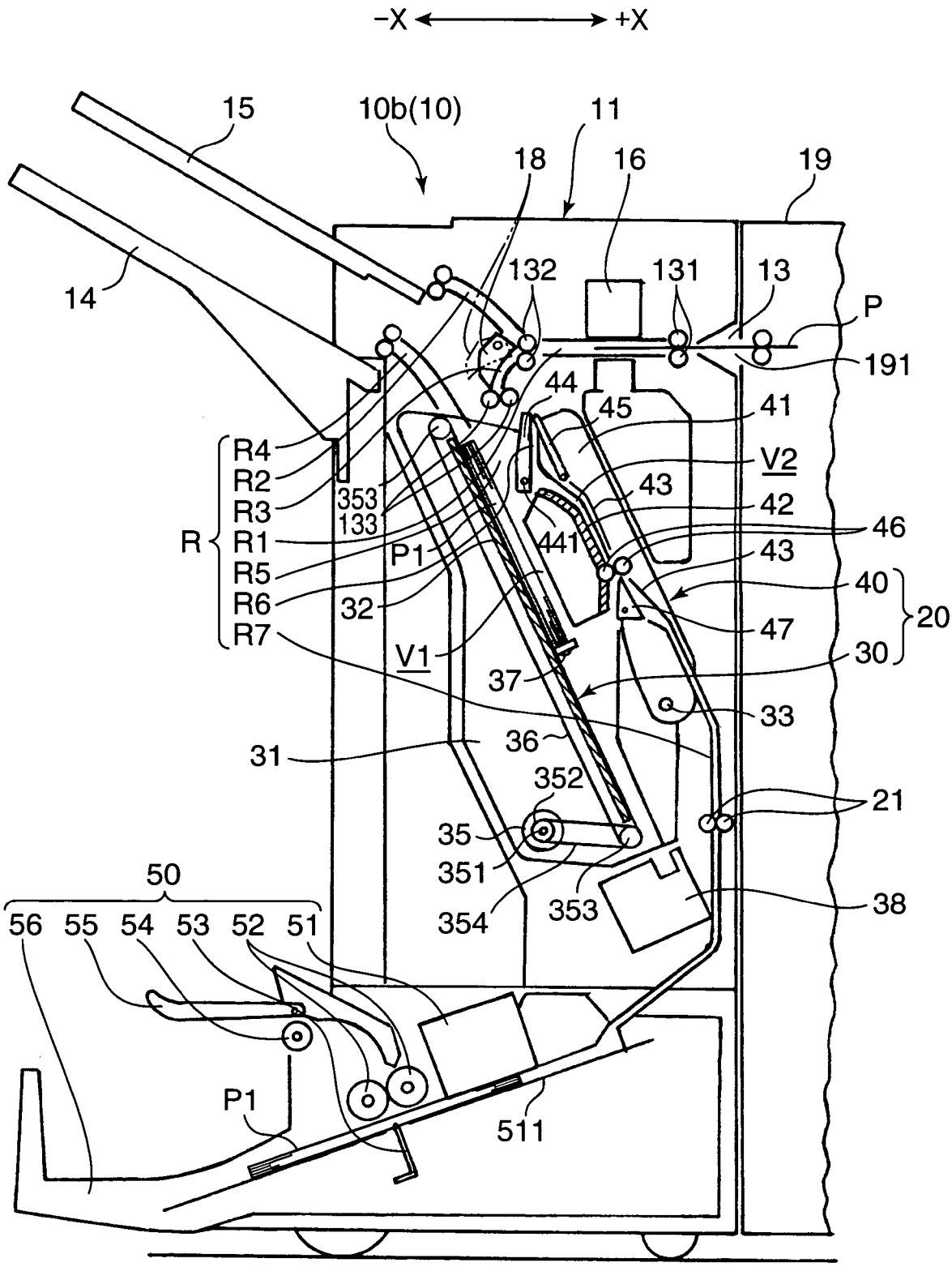
FIG. 3 is a front sectional explanatory diagram schematically showing an embodiment of an internal structure of the postprocessing apparatus when the center-folding unit is mounted thereon.

In FIGS. 1 through 3, X−X direction indicates a sideward direction, and Y−Y direction indicates a forward and backward direction. Specifically, −X, +X, −Y, and +Y directions indicate the first side, second side, front side and back side, respectively. Meanwhile, the reason why the X−X direction is not defined as a leftward and rightward direction is because the leftward and rightward direction in a sheet of the drawing and the leftward and rightward direction indicated by X is inversed and may cause a confusion in descriptions referring to the drawings in the case where a view seen from a backside of the postprocessing apparatus 10 is shown (for example, FIG. 4). Accordingly, to avoid such confusion, the wordings "leftward" and "rightward" are not used but the wordings "first sideward" and "second sideward" are adopted.

The postprocessing apparatus 10 according to the present embodiment is used selectively in either forms of a basic postprocessing apparatus 10*a* or a function-added postprocessing apparatus 10*b*. The basic postprocessing apparatus 10*a* has a structure in which only a stapling unit 10 (first postprocessing mechanism) as shown in FIGS. 1A, 1B and the center-folding unit 50 (second postprocessing mechanism) is not mounted in the housing 11. The function-added post processing apparatus 10*b* has a structure in which the center-folding unit 50 is selectively mounted in the basic postprocessing apparatus 10*a*.

First of all, an exterior view of the basic postprocessing apparatus 10*a* is described based on FIGS. 1A, 1B. The basic postprocessing apparatus 10*a* on which the center-folding unit 50 is not mounted is constructed by mounting various postprocessing members for performing a postprocessing to a recording sheet P (FIG. 3) in the housing 11 having a shape of box in an external view. The housing 11 includes a front plate 111, a second side plate 112, an unillustrated back plate, an unillustrated first side plate and a top plate member 113 and is formed to have a cuboid-like shape. The front plate 111 stands from a front edge of a bottom plate. The second side plate 112 stands from a second side edge of the bottom plate. The unillustrated back plate stands from a back edge of the bottom plate. The unillustrated first side plate stands from a first side edge of the bottom plate. The top plate member 113 is provided so as to cover respective upper edges of the front plate 111, the second side plate 112, the first side plate and the back plate.

The front plate 111 has a length set to be short in a height direction from the bottom plate. A storing space V (FIG. 1B) is provided in an upper portion of the front plate 111 for storing the stapling unit 20 for performing a stapling processing (first processing) to a stack of recording sheets. To close the storing space V, a front face door 12 indicated by two-dotted chain lines is provided. Meanwhile, FIGS. 1A, 1B show the state where the front face door 12 is opened.

In an upper portion of the second side plate 112, a sheet reception opening 13 for receiving the recording sheet P which is fed from an image forming apparatus (upstream device) 19 (FIG. 3) is provided. A perforating processing (punching processing) for perforating the recording sheet P which is to be fed into the basic postprocessing apparatus 10*a* through the sheet reception opening 13, a stapling processing of binding a stack P1 of recording sheets (FIG. 3) and the like are performed. The image forming apparatus 19 and the postprocessing apparatus 10 constitutes an image forming system according to an embodiment of the present invention.

In a side face on the first side of the basic postprocessing apparatus 10*a*, a main tray 14 is provided. Further, in a side portion on the first side of the top plate member 113, a sub-tray 15 is provided. The main tray 14 is adapted for receiving the stack P1 of recording sheets to which the stapling processing is performed and is so constructed as to be moved upward and downward by a driving of a predetermined lifting device. The main tray 14 is sequentially moved downward in accordance with increase in a number of the discharged stack P1 of the recording sheets. On the other hand, the sub tray 15 is adapted for receiving the recording sheets which are discharged without a postprocessing performed in the postprocessing apparatus 10 and receiving the recording sheets to which only the punching processing is performed.

On the second side in the upper portion of the housing 11, a punching unit 16 for perforating the recording sheet P which is just after being fed from the image forming apparatus 19 into the housing 11 through the sheet reception opening 13 is provided. On the first side of the punching unit 16, an upper frame plate 114 for supporting various rollers is provided so as to face a front face opening of the storing space V. In the lower side of the upper frame plate 114 on the first side of the postprocessing apparatus 10, a triangular frame plate 115 is provided so as to face the front face opening of the storing space V. The triangular frame plate 115 has a substantially triangular shape and is formed to slant downward in the postprocessing apparatus 10 from the upper first side to the second side.

In a second side position of the triangular frame plate 115 in the lower side of the upper frame plate 114, the stapling unit 20 is provided for temporarily storing a predetermined number of the recording sheets P which are fed from the image forming apparatus 19 and performing the stapling processing to the formed stack P1 of recording sheets with the binding needle.

The stapling unit 20 includes a stapling tray 30 and an alternating tray 40. The stapling tray 30 is provided at a slant just on the second side of the triangular frame 115. The alternating tray 40 is provided rotatably with respect to the stapling tray 30 so as to face along the slanted surface of the stapling tray 30 on the second side.

The stapling tray 30 includes a pair of first frame plates 31 provided in a forward and backward direction and an intermediate tray main body 32 (FIG. 3) provided at a slant between the pair of first frame plates 31. On the other hand, the alternating tray 40 includes a second frame plate 41 provided in a forward and backward direction and an alternating tray main body 42 (FIG. 3) provided between the pair of second frame plates 41 while being parallel to the intermediate tray main body 32.

Among the pair of first frame plates 31, one provided in the front side is covered with a decorative plate 310. This state is indicated in FIG. 1A by showing the decorative plate 310 with a partially notched portion. However, unless especially distinguished, these are integrally called the first frame plate 31.

In a predetermined portion in a lower second side portion of the stapling tray 30, a connecting shaft 33 extending between the first frame plates 31 are provided. A lower end portion of the alternating tray 40 is penetratedly conjugated with the connecting shaft 33. Accordingly, the alternating tray 40 is rotatable in opposite directions. A posture of the alternating tray main body 42 can be changed to a closing posture S1 covering the intermediate tray main body 32 and closing the same as indicated by a solid line in FIG. 1A and to an opening posture S2 opening the intermediate tray main body 32 as indicated by a two-dotted chain line in FIG. 1B.

Between the intermediate tray main body 32 and the alternating tray main body 42, a postprocessing space V1 (FIG. 3) having a predetermined space for storing the recording sheet P is formed. A predetermined number of the recording sheets P are sequentially fed into the postprocessing space V1 to thereby form the stack P1 of recording sheets. Then, the stapling processing is performed to the stack P1 of the recording sheets.

When a sheet jamming occurs in the postprocessing space V1 of the stapling unit 20, the stapling unit 20 is pulled out of the storing space V of the postprocessing apparatus 10 by a manual operation by an operator (FIG. 1B). In this state, the posture of the alternating tray 40 is changed from the closing posture S1 indicated by the solid line to the opening posture S2 indicated by the two-dotted line. Accordingly, the jammed recording sheet P is exposed to an outer portion and is easily removed by the operator.

In the present embodiment, the stapling unit 20 is guided by a pair of guiding members 34 (FIG. 1B) provided in a sideward direction in a slightly lower portion from a central portion of the stapling tray 30 in an upper and lower direction. Accordingly, the stapling unit 20 is detachably inserted into the storing space V of the basic postprocessing apparatus 10*a*. Only the guiding member 34 in the second side is illustrated in FIG. 1B as a matter of illustration.

The guiding member 34 includes a fixed rail 341, a movable rail 342 and a retainer 343. The fixed rail 341 is fixed on the inner side of the second side plate 112 and the first side plate of the housing 11 and extends in a forward and backward direction. The movable rail 342 is fixed on the side of the stapling tray 30 and faces the fixed rail 341. The retainer 343 is provided between the fixed rail 341 and the movable rail 342.

According to the guiding member 34, when an operation of inserting or withdrawing the stapling tray 30 with respect to the storing space V of the postprocessing apparatus 10 is performed, the movable rail 342 moves through the retainer 343 which moves between the fixed rails 341 and the movable rails 342 in a forward an backward direction while being guided by the fixed rails 341. Accordingly, the stapling tray 30 can be withdrawn smoothly from the storing space V and stored smoothly in the storing space V.

In a predetermined portion of the first frame plate 31 on the front side, a gripping band 311 made of a flexible material such as a synthetic resin sheet is provided. By gripping the gripping band 311 and pulling the same in a forward direction, the stapling unit 20 stored in the storing space V can be pulled outward (FIG. 1B).

Next, as shown in FIG. 3, the postprocessing apparatus 10 has a sheet conveyance passage R adapted for conveying the recording sheet P that is fed from the image forming apparatus 19 to various portions of the postprocessing apparatus 10, as described below.

The sheet conveyance passage R includes an inlet side conveyance passage R1, a sub tray directed conveyance passage R2, a stapling unit directed conveyance passage R3, a main tray directed conveyance passage R4, a stapling tray directed conveyance passage R5, an alternating tray directed conveyance passage R6 and a center-folding unit directed conveyance passage (conveyance passage) R7. The inlet side conveyance passage R1 extends toward the first side from the sheet reception opening 13 of the postprocessing apparatus 10 to a substantially central position in a horizontal direction of the postprocessing apparatus 10. The sub tray directed conveyance passage R2 is diverged at the downstream end of the inlet side conveyance passage R1 and extends toward the sub tray 15. The stapling unit directed conveyance passage R3 diverged at the downstream end of the inlet side conveyance passage R1 and extends toward the postprocessing space V1 of the stapling unit 20. The main tray directed conveyance passage R4 extends from the upper end of the postprocessing space V1 toward the main tray 14. The stapling tray directed conveyance passage R5 is diverged at the downstream end of the stapling unit directed conveyance passage R3 on the first side and extends toward the stapling tray 30. The alternating tray directed conveyance passage R6 is diverged at the downstream end of the stapling unit conveyance passage R3 and extends toward the second side. The center-folding unit directed conveyance passage (conveyance passage) R7 passes through the alternating tray 40 and extends toward the center-folding unit 50.

The center-folding unit directed conveyance passage R7 functions in the state where the function-added postprocessing apparatus 10*b* is formed by mounting the center-folding unit 50 on the basic postprocessing apparatus 10*a*. Since there exists no center-folding unit 50 in the basic postprocessing apparatus 10*a* shown in FIG. 1, the center-folding unit directed conveyance passage R7 does not function.

The punching unit 16 is provided at an upper position in the inlet side conveyance passage R1. In the state where the recording sheet P led to the inlet side conveyance passage R1 through the sheet reception opening 13 is temporarily retained is suspended, a punching processing is performed with a driving of the punching unit 16 so that holes are formed at a predetermined portion of the recording sheet P.

At the downstream end of the inlet side conveyance passage R1, a switching guide 18 is provided. The switching guiding member 18 is adapted for switching the passage of the recording sheet P to the sub tray directed conveyance passage R2 and to the stapling unit directed conveyance passage R3. When the stapling processing is not performed to the stack P1 of recording sheets, the recording sheet P is discharged to the sub tray 15 through the sub tray directed conveyance passage R2 in accordance with a predetermined posture setting of the switching guide 18. On the other hand, when the stapling processing is performed to the stack P1 of the recording sheets, the recording sheet P is conveyed to the stapling unit 20 through the stapling unit directed conveyance passage R3 by changing a posture of the switching guide 18. Then, in the state where a predetermined number of recording sheets P are stored in the postprocessing space V1 and the stack P1 of recording sheets is formed, the stapling processing is performed to the stack P1 of recording sheets. The stack P1 of recording sheets after the stapling processing is performed thereto is discharged to the main tray 14 through the main tray directed conveyance passage R4.

The center-folding unit directed conveyance passage R7 extends toward the lower side from a substantially intermediate portion in an upward and downward direction of the alternating tray 40. The recording sheet P which is to be subjected to the center-folding processing is led to the center-folding unit 50 through the center-folding unit directed conveyance passage R7 after passing through an upper portion of the alternating tray main body 42. As shown in FIG. 3, in the state where the function-added postprocessing apparatus 10*b* is formed by mounting the center-folding unit 50 on the basic postprocessing apparatus 10*a*, a downstream portion of the center-folding unit directed conveyance passage R7 is formed to head downward from the lower end of the stapling unit 20 toward the first side.

Hereinafter, a structure of the stapling unit 20 is described based on the FIG. 3 and with reference to FIGS. 1A, 1B if it is necessary. As shown in FIG. 3, the stapling tray 30, which is a component of the stapling unit 20, includes a belt motor 35 provided at a predetermined portion of the pair of the first frame plates 31 facing each other in a forward and backward direction (a direction which is perpendicular to a sheet of FIG. 3) such that a driving shaft 351 in a forward and backward direction. A driving roller 352 is integrally and rotatably mounted on the driving shaft 351. On the other hand, a predetermined shaft is provided between the pair of first frame plates 31 in an upper end position and a lower end position of the intermediate tray main body 30. At a central position in a forward and backward direction of each shaft, a driven roller 353 is coaxially supported. A lifting belt 36 is hanged over the pair of driven rollers 353 so as to surround the intermediate tray main body 32.

A driving of the belt motor 35 is transmitted to the lifting belt 36 through the communicating belt 354 hanged over the driving rollers 352 and the driven roller 353 on the lower side. Thus, when the belt motor 35 is driven, the lifting belt 36 is revolved between the pair of driven rollers 353.

On a surface side of the lifting belt 36, a sheet receiving member 37 for receiving the stack P1 of recording sheets in the postprocessing space V1 and lifting or lowering the same is provided. Further, at a position corresponding to a lower end portion of the intermediate tray main body 32, an end binding stapler 38 (shown in an oval in FIGS. 1A and 2) for performing the stapling processing to the stack P1 of recording sheets is provided. The end binding stapler 38 is fixed on a predetermined frame in the housing 11 and performs the end binding stapling processing to an end portion of the stack P1 of recording sheets in the state where the stack P1 is supported by the sheet receiving member 37 positioned at a lower end portion of the intermediate tray main body 32.

The stack P1 of recording sheets to which the stapling processing is performed by the stapler 38 in a lower end portion of the intermediate tray main body 32 is lifted up in the postprocessing space V1 by an upward movement due to a revolving of the sheet receiving member 37 by a driving of the belt motor 35 in a counter-clockwise direction through the driving roller 352 and the driven roller 353. Then, the stack P1 of recording sheets passes through the main tray directed conveyance passage R4 and is discharged to the main tray 14.

The sheet receiving member 37 after the stack P1 of recording sheets is discharged moves to a back side of the intermediate tray main body 32 via the upper driven roller 353 due to a continuous driving of the belt motor 35, and is put back to a home position determined at a slightly upper position of the driven roller 353 on the lower back side of the intermediate tray main body 32. Then, when the stapling processing is performed to the stack P1 of the recording sheets, the lifting belt 36 is rotated in a counter-clockwise direction by a driving of the belt motor 35 and is moved toward a predetermined position on the front side of the intermediate tray main body 32 through the lower driven roller 353.

Further, the stapling tray 30 is provided with a width adjuster for performing an aligning processing to the stack P1 of recording sheets by aligning a width of the stack P1 of recording sheets led to the postprocessing space V1 and supported by the sheet receiving member 37, and a back end (upper end) adjuster for aligning a back end (upper end) of the stack P1 of recording sheets received on the sheet receiving member 37.

The alternating tray 40 includes an alternating tray main body 42, a cover plate 43, a diverging guide 44, a pressing member 45, a pair of valve rollers 46 and a second switching guide 47.

The alternating tray main body 42 is provided between the pair of second frame plates 41 in the state of facing the intermediate tray main body 32 so as to form the postprocessing space V1 with the intermediate tray main body 32 in the state where a posture is set in a closing posture Si (FIG. 3). The cover plate 43 is provided between the pair of second frame plates 41 so as to face an upper face side of the alternating tray main body 42.

The diverging guide 44 is provided on the upper side at a slightly upper position from the upper end of the cover plate 43 and is adapted for sorting the recording sheet P conveyed from the stapling unit directed conveyance passage R3 to the postprocessing space V2 of the stapling tray 30 and to the retreating space V1 of the alternating tray 40. Particularly, the diverging guide 44 is provided between the stapling tray directed conveyance passage R5 and the alternating tray directed conveyance passage R6 and is adapted for making the recording sheet P conveyed from the stapling unit directed conveyance passage R3 move toward the stapling tray directed conveyance passage R5 and to the alternating tray directed conveyance passage R6.

The pressing member 45 is provided in a vicinity of an upper end position of the cover plate 43 and is adapted for pressing the recording sheet P conveyed from the stapling unit directed conveyance passage R3 toward the diverging guide 44. The pair of valve rollers 46 temporarily store the recording sheet P conveyed from the stapling unit directed conveyance passage R3 to the retreated space V2 and, on the other hand, conveys the recording sheet P toward the lower side by its driving. The second switching guide 47 is provided at a direct lower position of the pair of valve rollers 46 and is adapted for switching the direction of conveyance of the recording sheet P led into the alternating tray 40 to the postprocessing space V1 of the stapling tray 30 and to the center-folding unit directed conveyance passage R7.

The alternating tray main body 42 has a length which is set so that its lower end portion is positioned at an approximately central portion in an upward and downward direction of the intermediate tray main body 32. On the other hand, the length of the cover plate 43 is set to be long enough so that the lower end portion of the cover plate is positioned at a slightly upper position of the connecting shaft 33. Accordingly, the recording sheet P conveyed toward the lower side from the retreating space V2 by a driving of the pair of valve rollers 46 is guided by the lower portion of the cover plate 43 and is assuredly moved toward the center-folding unit directed conveyance passage R7.

On the upstream end of the inlet side conveyance passage R1, a pair of receiving rollers 131 for receiving the recording sheet P conveyed from the sheet inlet opening 13 is provided. On the downstream end a pair of conveying rollers 132 for conveying the recording sheet P toward the downstream side is provided. The recording sheet conveyed by the pair of conveying rollers 132 is conveyed to either one of the sub tray directed conveyance passage R2 and the stapling unit directed conveyance passage R3 in accordance with a posture set in the switching guide 18.

Meanwhile, in an example shown in FIG. 3, a solid line indicates the state of the switching guide 18 where a posture thereof is set so as to make the recording sheet P moved toward the stapling unit directed conveyance passage R3, and two-dotted chain line indicates the state of the switching guide 18 where a posture thereof is set so as to make the recording sheet P move toward the sub tray directed conveyance passage R2.

At a downstream end of the stapling unit directed conveyance passage R3, a pair of leading rollers 133 are provided so as to face an upper portion of the alternating tray main body 42 and adapted for leading the recording sheet P from the inlet side conveyance passage R1 to an upper portion of the stapling unit 20.

The alternating tray main body 42 has a length which is set so that an upper edge portion of the alternating tray main body 42 is positioned at a substantially direct lower position of the pair of leading rollers 133 through the diverging guide 44, and a lower edge portion is positioned at a substantially intermediate position in an upward and downward direction of the intermediate tray main body 32. On the other hand, a size and shape of the cover plate 43 is set so that a height level of the upper edge portion is substantially the same as that of the upper edge portion of the alternating tray main body 42, and that the lower edge portion is positioned on the lower side from the lower edge portion of the alternating tray main body 42 to thereby lead the recording sheet P to the center-folding unit directed conveyance passage R7. Between the alternating tray main body 42 and the cover plate 43 which are located in an upper side from the pair of valve rollers 46, the retreating space V2 for temporarily retreating the detoured recording sheet P is formed. Further, the center-folding unit directed conveyance passage R7 is formed on a back side of the cover plate 43 at a position lower than the pair of valve rollers 46.

In the present embodiment, an end-binding stapler 38 is provided on a side of the housing so as to face a lower end portion of the stapling tray 30. For this reason, the center-folding unit directed conveyance passage R7 has a long length so as to detour the end-binding stapler 38. To smoothly conveying the recording sheet P to the center-folding unit 50 through the center-folding unit conveyance passage R7, a pair of conveying rollers (conveying members) 21 are provided at a predetermined portion in the center-folding unit directed conveyance passage R7. The recording sheet P is smoothly and assuredly conveyed to the center-folding unit 50 with a driving of the pair of conveying rollers 21.

The center-folding unit 50 which is selectively mounted in the basic postprocessing apparatus 10*a* is, as shown in FIG. 3, mounted at a lower side position of the stapling unit 20. The center-folding unit 50 is adapted for performing a so-called center-bending processing. In the center-folding unit 50, the stapling processing is performed to the stack P1 of the recording sheets P which has passed through the stapling unit 20 without being performed the stapling processing at a central position in the conveyance direction and are bent into two-fold along the central position.

The center-folding unit 50 includes a center-binding stapler 51, a pair of center-folding rollers 52, a pressing member 53, a discharging roller 54, a holding member 55 and a center-folding tray 56. The center-binding stapler 51 is provided in a central upper portion of the center-folding unit directed conveyance passage R7. The pair of center-folding rollers 52 are provided on slightly downward side from the center-binding stapler 51 and on the upper side position in the center-folding unit directed conveyance passage R7. The pressing member 53 is a plate-like member provided in a lower portion of the center-folding unit directed conveyance passage R7 facing the pair of center-folding roller 52 and crosses the center-folding unit directed conveyance passage R7. The discharging roller 54 is provided on the downstream side from the pair of center-folding rollers 52. The holding member 55 is provided movably about a predetermined shaft on the downstream side from the discharging roller 54. The center-folding tray 56 is adapted for receiving stack P1 of the recording sheets to which the center-folding processing is performed and discharged to an outer portion through the holding member 55.

The center-binding stapler 51 is provided exclusively for the stack P1 of recording sheets to which the center-folding processing is performed. Further, in FIG. 3, the stack P1 of recording sheets is shown in the state just before the center-folding processing is performed.

The recording sheet P led to the center-folding unit 50 through the center-folding unit directed conveyance passage R7 is successively stacked on a center-folding unit tray 511 which is positioned so as to face a lower position of the center-binding stapler 51. Then, the aligning processing is performed in the state where the stack P1 of a predetermined number of recording sheets which are to be subjected to the center-folding processing is formed, and the stapling processing is performed by the center-binding stapler 51 to the stack P1 of recording sheets to which the aligning processing is performed. On the downstream side from a portion where the stack P1 of recording sheets is subjected to the stapling processing for the center-binding is performed, the center-folding processing is performed by the pair of center-folding rollers 52 and the pressing member 53.

The pressing member 53 presses a portion of the stack P1 of recording sheets where the stapling processing is performed in the center-binding stapler 51 toward a portion between the pair of center-folding rollers 52 by a driving of an unillustrated driver in the state where the stack P1 of recording sheets is conveyed to the center-folding unit directed conveyance passage R7. The stack P1 of recording sheets pressed by the pressing member 53 and bent in a central portion thereof is pressingly inserted to the center-folding conveyance passage by a driving of the pair of center-folding rollers 52 and discharged to the center-folding tray 56 through the discharging roller 54 and the holding member 55.

Figure 4:
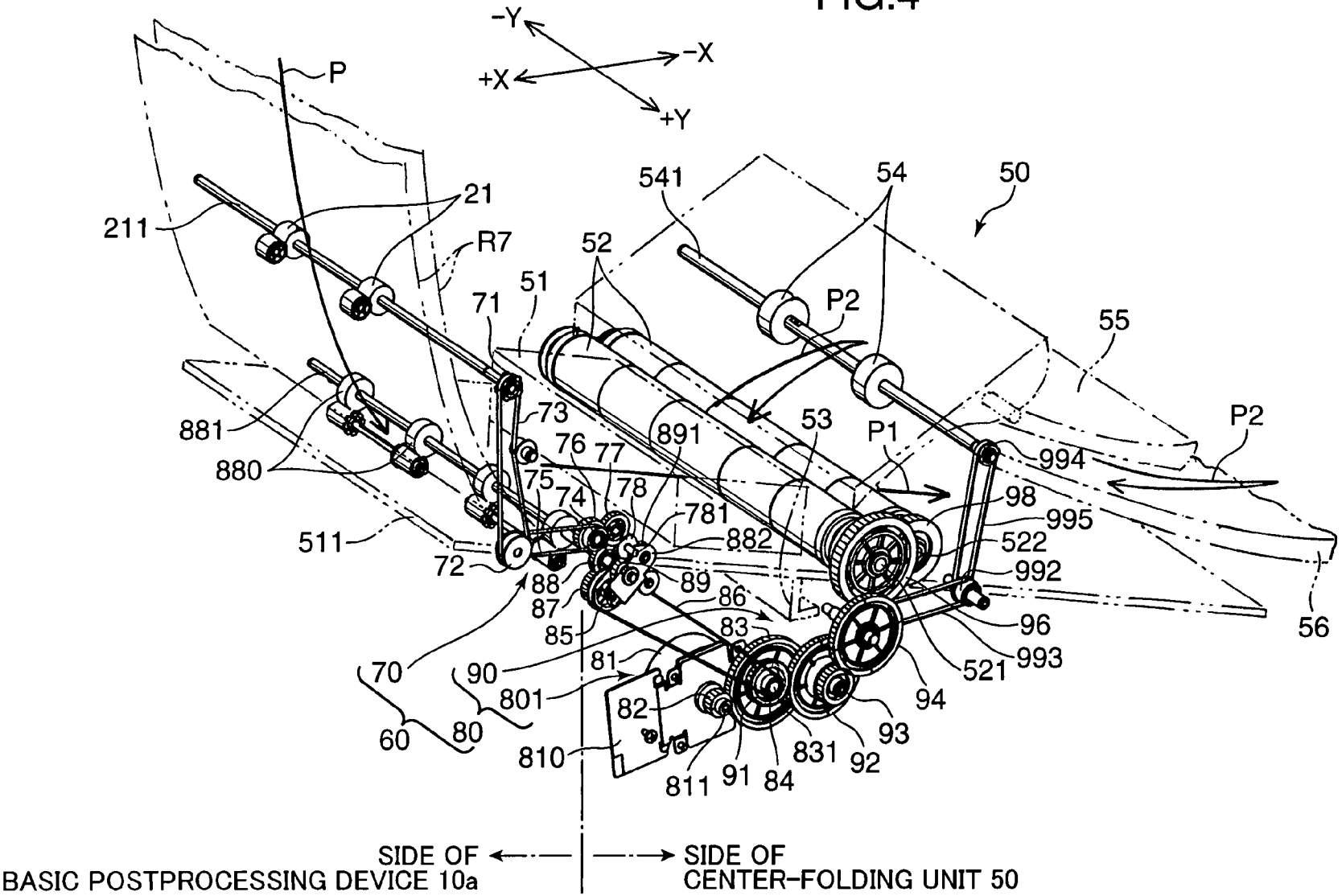
FIG. 4 is a perspective skeleton view for describing a driving force transmission mechanism for a sheet conveyance relating to the center-folding unit.
Figure 5A:
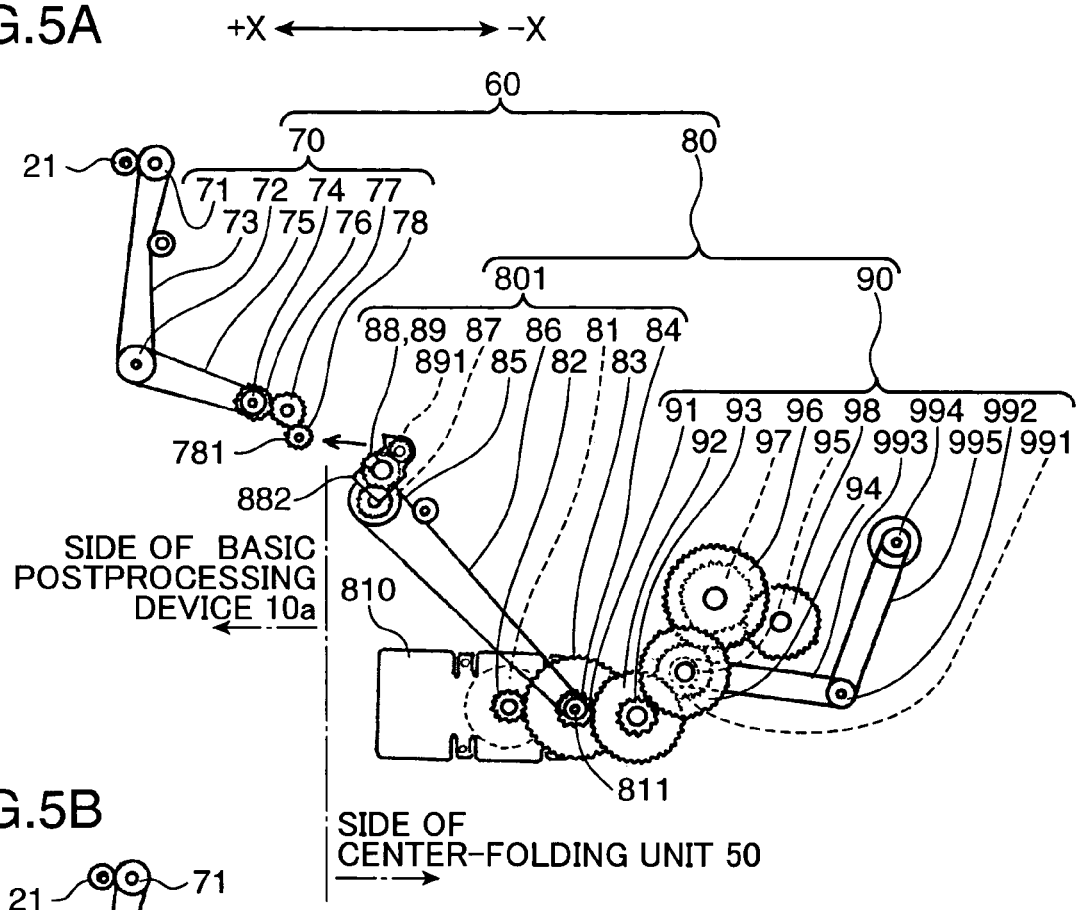
FIGS. 5A, 5B are rear views of the driving force transmission mechanism shown in FIG. 4.
Figure 5B:
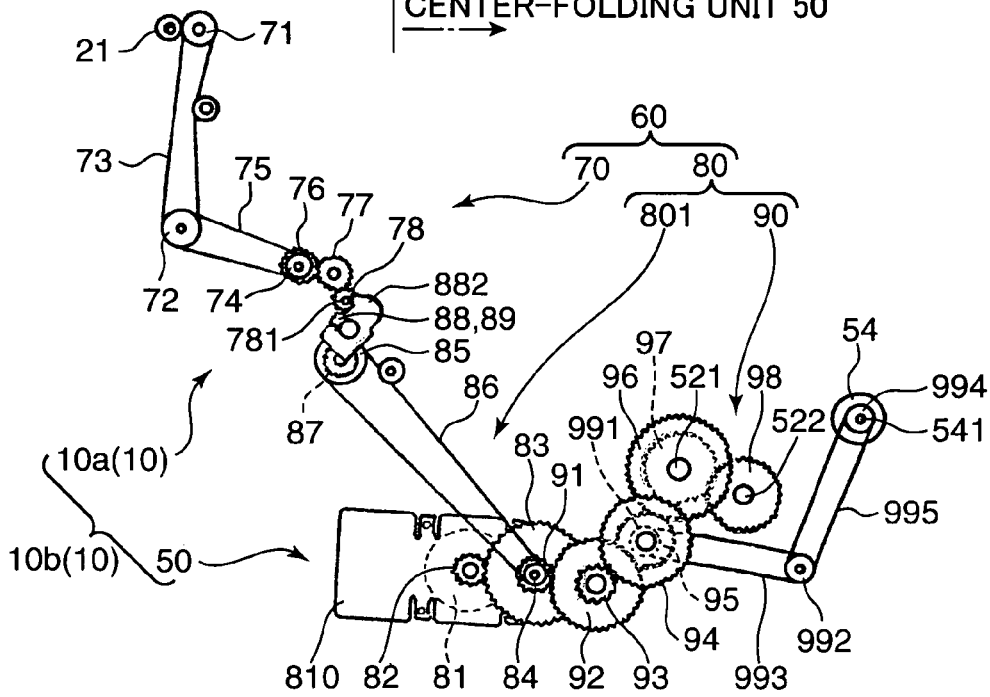

Hereinafter, a driving force transmission mechanism for a sheet conveyance in the center-folding unit 50 is described. FIG. 4 is a perspective skeleton view for describing the driving force transmission mechanism for a sheet conveyance in the center-folding unit 50. Further, FIGS. 5A, 5B are back views of the driving force transmission mechanism shown in FIG. 4. FIG. 5A shows the state just before the center-folding unit 50 is connected to the basic postprocessing apparatus 10*a*. FIG. 5B shows the state where the center-folding unit 50 is connected to the basic postprocessing apparatus so that the function-added postprocessing apparatus 10*b* is formed. Further, directions indicated by X and Y in these figures is the same as the case of FIG. 1 (X denotes sideward direction (−X: first side, +X: second side), and Y denotes forward and backward direction (−Y: front, +Y: back)).

The driving force transmission mechanism for the sheet conveyance in the center-folding unit 50 is divided into two parts by a one-dotted chain line shown in FIG. 4. Namely, in FIG. 4, the first side from the single-dot line shows members in the driving force transmission mechanism on the side of the center-folding unit 50, and the second side from the one-dotted chain line shows members in the driving force transmission mechanism on the side of the basic post processing apparatus 10*a*.

As shown in FIG. 4, a driving force transmission mechanism 60 includes a basic postprocessing apparatus side driving force transmission mechanism 70 (including a first connecting gear) provided in the basic postprocessing apparatus 10*a* and a center-folding unit side driving force transmission mechanism 80 (including a second connecting gear).

In the present embodiment, the center-folding unit side driving force transmission mechanism 80 is provided with a driver. A driving force is transmitted from the mechanism 80 to the basic postprocessing apparatus side driving force transmission mechanism 70. Consequently, the driving force transmission mechanism 60 functions as a whole. This is because the center-folding unit 50 is an optional device which is selectively adopted and is not necessarily adopted, and including the driver for driving the center-folding unit side driving force transmission mechanism 80 on the side of the basic postprocessing apparatus 10*a* is not economically expedient.

The mechanism 70 includes a discharging roller pulley 71, an idle pulley 72, an endless belt 73, a driving pulley 74, an endless belt 75, a driving pulley gear 76, an idle gear 77, a basic postprocessing apparatus side connecting gear 78 (first connecting gear). The discharging pulley 71 is coaxially placed on a rear end portion of a discharging roller shaft 211 of one roller of the pair of discharging rollers 21 and is integrally rotatable with the discharging roller shaft 211. The idle pulley 72 is supported rotatably about a predetermined shaft positioned at a lower side position of the discharging roller pulley 71. The endless belt 73 extends between the idle pulley 72 and the discharging roller pulley 71. The driving pulley 74 is supported rotatably about a predetermined shaft so as to face the first side of the idle pulley 72. The endless belt 75 extends between the driving pulley 74 and the idle pulley 72. The driving pulley gear 76 is provided so as to be coaxially and integrally rotatable with the driving pulley 74. The idle gear 77 engages with the driving pulley gear 76 on the first side of the driving pulley gear 76. The basic postprocessing apparatus side connecting gear 78 is supported rotatably about a supporting shaft 781 and engages with the idle gear 77 on the first side of the idle gear 77. A driving force from the center-folding unit side driving force transmission mechanism 80 is transmitted to the connecting gear 78 in the state where the center-folding unit 50 is mounted in the basic postprocessing apparatus 10*a*.

According to the mechanism 70 constructed in such a way, when a driving force from the center-folding unit side driving power transmission mechanism 80 is transmitted to the connecting gear 78, the driving force is transmitted to the driving pulley gear 76 through the idle gear 77. With a rotation of the driving pulley gear 76 according to the transmission, the driving pulley 74 is integrally rotated. The rotation is transmitted to the idle pulley 72 through a revolving of the endless belt 75. Then, the rotation of the idle pulley 72 is transmitted to the discharging roller pulley 71 through the revolving of the endless belt 73. Accordingly, the discharging roller pulley 71 is rotated. Consequently, a roller on the first side of the pair of discharging rollers 21 is integrally rotated with the discharging roller shaft 211 which is integral with the discharging roller pulley 71.

Thus, the recording sheet P which passes through the center-folding unit directed conveyance passage R7 and then reaches the pair of discharging rollers 21 is led by a rotation of the pair of discharging rollers 21 and discharged toward the center-folding unit 50 stably.

The center-folding unit side driving force transmission mechanism 80 has a basic construction including a first transmission mechanism 801 and a second transmission mechanism 90. The first transmission mechanism 801 is so constructed as to transmit a driving force to the mechanism 70. The second transmission mechanism 90 is so constructed as to transmit the driving force from the first transmission mechanism 801 to the pair of center-folding rollers 52 and the conveying roller 54.

The first transmission mechanism 801 includes a driving motor (driver) 81, a small diameter gear 82, a first gear 83 having a large diameter, a first pulley 84, a second pulley 85, an endless belt 86, a second gear 87, a third gear 88, a fourth gear 89 and a center-folding unit side connecting gear 891. The driving motor 81 is installed on a supporting frame 810 provided on the second side on the backward side in the center-folding unit 50 in such a manner that a driving shaft 811 extends in a forward and backward direction. The small diameter gear 82 is mounted so as to be coaxially and integrally rotatable with the driving shaft 811 of the driving motor 81. The first gear 83 has a larger diameter than the small diameter gear 82 and engages with the small diameter gear 82 so as to be rotated about the first shaft 831. The first pulley 84 is integrally rotated about the first shaft 831 and is coaxial with the first gear 83. The second pulley 85 is supported freely rotatably about a predetermined shaft which is provided at an upper position on the second side of the driving motor 81 and extends in a forward and backward direction. The endless belt 86 extends between the second pulley 85 and the first pulley 84. The second gear 87 is integrally and coaxially rotatable with the second pulley 85. The third gear 88 engages with and integrally rotates about the second gear 87. The fourth gear 89 is coaxial with the third gear 88 and is supported integrally rotatably by the second roller shaft 881 at a position on the back side from the third gear 88. The center-folding unit side connecting gear 891 (second connecting gear) engages with the fourth gear 89.

Meanwhile, in the present embodiment, the driving motor 81 is drivingly rotated in a counter-clockwise direction in FIG. 4. Further, on the second roller shaft 881, a roller on the first side in the pair of receiving rollers 880 for receiving the recording sheet P in the center-folding unit 50 is coaxially and integrally rotatably mounted.

A mounting position of the center-folding unit side connecting gear 891 is set so as to engage with the basic postprocessing unit side connecting gear 78 in the state where the center-folding unit 50 is mounted in the basic postprocessing apparatus 10*a*. The second roller shaft 881 is supported by a position determining plate 882 which is a kind of a frame provided in the center-folding unit 50. A shape of the position determining plate 882 is formed so that its upper portion comes in contact with the supporting shaft 781 in the state where the center-folding unit 50 is mounted in the basic postprocessing apparatus 10*a*. Accordingly, the center-folding unit side connecting gear 891 is assuredly engaged with the basic postprocessing apparatus side connecting gear 78 in the position-determining state.

According to the first transmission mechanism 801, a rotation of the basic postprocessing apparatus side connecting gear 78 to which a driving force is transmitted from the first transmission mechanism 801 is transmitted to the driving pulley 74 through the idle gear 77 and the driving pulley gear 76. The idle pulley 72 is rotated by a revolving of the endless belt 75 due to the transmission, and then the rotation is transmitted to the discharging roller shaft 211 through the endless belt 73 and the discharging roller pulley 71. Due to the rotation of the pair of discharging roller 21 by this, the recording sheet P is conveyed along the center-folding unit directed conveyance passage R7 and discharged toward the center-folding unit 50.

The second transmission mechanism 90 includes a fifth gear 91, a sixth gear 92, a seventh gear 93, an eighth gear 94, a ninth gear 95, a tenth gear 96, an eleventh gear 97, a twelfth gear 98, a third pulley 991, a fourth pulley 992, an endless belt 993, a fifth pulley 994 and an endless belt 995. The fifth gear 91 is supported freely rotatably about a predetermined shaft and is integrally and concentrically rotated with the first gear 83. The sixth gear 92 engages with the fifth gear 91 and is rotatable about a predetermined shaft. The seventh gear 93 has a small diameter and is concentrically and integrally rotated with the sixth gear 92. The eighth gear 94 engages with the seventh gear 93 and is rotated about a predetermined shaft. The ninth gear 95 is concentrically and integrally rotated with the eighth gear 94. The tenth gear 96 is supported integrally rotatably about the first center-folding roller shaft 521 and engages with the ninth gear 95. The eleventh gear 97 is supported on the first center-folding roller shaft 521 integrally rotatably with the tenth gear 96. The twelfth gear 98 engages with the eleventh gear 97 and is supported integrally about the second center-folding roller shaft 522. The third pulley 991 is provided concentrically and integrally rotatably with the eighth gear 94. The fourth pulley 992 is supported freely rotatably about a predetermined shaft which is provided on the first side position from the third pulley 991. The endless belt 993 is stretchedly provided between the fourth pulley 992 and the third pulley 991. The fifth pulley 994 is provided concentrically and integrally rotatably about the conveying roller shaft 541. The endless belt 995 is stretchedly provided between the fifth pulley 994 and the fourth pulley 992.

According to the second transmission mechanism 90, the rotation of the first gear 83 by the driving of the driving motor 81 through the small-diameter gear 82 is transmitted to the tenth gear 96 through the fifth to ninth gears 91 to 95. By rotations of the eleventh gear 97 and the twelfth gear 98 in directions opposite to each other due to this, the pair of center-folding rollers 52 rotate in directions opposite to each other (the roller on the first side rotates in a clockwise direction, and the roller on the second side rotates in a counter-clockwise direction). Further, a rotation of the eighth gear 94 is transmitted to the endless belt 993 which is stretchedly provided between the third pulley 991 and the fourth pulley 992. Accordingly, the endless belt 993 is revolved. A rotation of the fourth pulley 992 according to this is transmitted to the fifth pulley 994 through the endless belt 995. By a rotation of the fifth pulley 994, discharging roller 52 is rotated in a clockwise direction.

When the center-folding unit 50 is mounted in the basic postprocessing apparatus 10*a*, as shown in FIG. 5A, the center-folding unit 50 is moved from the first side toward the basic postprocessing apparatus 10*a*. A hook-shaped portion in an upper end portion on the second side of the position determining plate 882 is made come in contact with the supporting shaft 781 on the side of the basic postprocessing apparatus 10*a*, and then the center-folding unit 50 is fixed to the basic postprocessing apparatus 10*a*.

Accordingly, as shown in FIG. 5B, the center-folding unit side connecting gear 891 engages with the basic postprocessing apparatus side connecting gear 78. Thereafter, the driving force of the driving motor 81 is transmitted to the pair of discharging rollers 21 through the connecting gears 891, 78.

Then, in the state where the function-added postprocessing apparatus 10*b* is formed by mounting the center-folding unit 50 on the basic postprocessing apparatus 10*a* (FIGS. 2 through 4 and 5B), the stapling processing is performed by the center-folding stapler 51 to a central portion of the stack P1 formed by recording sheets P which passed through the center-folding unit directed conveyance passage R7 and supplied to the center-folding unit 50. After then, the stack P1 of recording sheets is pressed in to a position between the pair of center-folding roller pair 52 by an upward movement of the pressing member 53. Due to the center-folding processing, the stack P1 becomes a center-bent stack P2 of recording sheets. The center-bent stack P2 is discharged to the center-folding tray 56 while being guided by the discharging roller 54.

As described above in detail, the postprocessing apparatus 10 (basic postprocessing apparatus 10*a* and function-added postprocessing apparatus 10*b*) according to the present embodiment is so constructed as to perform the stapling processing to the recording sheet stack P1 which is fed from the image forming apparatus 19 into the housing 11 and to selectively mount the center-folding unit 50 for performing the center-folding processing to the recording sheet stack P1 on the housing 11. The stapling unit 20 is provided with the center-folding unit directed conveyance passage R7 for conveying the recording sheet P to the center-folding unit 50 in the state where the center-folding unit 50 is mounted in the housing 11. Further, the center-folding unit directed conveyance passage R7 is provided with the pair of conveying rollers 21 driven with a transmission of a driving force from the driving motor 81 provided on the side of the center-folding unit 50 for conveying the recording sheet P.

Thus, in the case where the center-folding unit 50 is not mounted in the housing 11, only the stapling processing in the stapling unit 20 in the housing 11 is performed to the recording sheet P fed from the image forming apparatus 19 to the postprocessing apparatus 10, and then the postprocessing in the postprocessing apparatus 10 is terminated. On the other hand, in the case where the center-folding unit 50 for performing the center-folding processing to the recording sheet stack P1 is selectively mounted in the housing 11 and the processing by the center-folding unit 50 is selected, the center-folding processing is performed to the recording sheet stack P1.

Further, the stapling unit 20 includes the center-folding unit directed conveyance passage R7 for conveying the recording sheet P to the center-folding unit 50, and the conveyance passage R7 is provided with the pair of delivering rollers 21. Accordingly, the recording sheet P passing through the conveyance passage R7 and delivered to the center-folding unit 50 is assuredly and smoothly conveyed by a driving of the pair of conveying rollers 21 from the stapling unit 20 to the center-folding unit 50.

Such pair of conveying rollers 21 provided in the conveyance passage R7 is driven by a transmission of a driving force from the driving motor 81 provided in the center-folding unit 50. Accordingly, it becomes unnecessary to provide devices such as a driving motor for driving the pair of driving rollers 21 in the stapling unit 20. Accordingly, in the case where the center-folding unit 50 is not mounted in the housing 11 selectively, there exists no driving force transmission mechanism which is unnecessary and not used in the stapling unit 20 so that it contributes to a reduction of a cost for the device. On the contrary, in the case where the center-folding unit 50 is selectively mounted in the housing 11, a driving force from the driving motor 81 provided in the center-folding unit 50 is transmitted to the pair of conveying rollers 21 so that the pair of conveying rollers 21 can be driven without any interference.

In the above-described embodiment, the stapling processing is set as the first postprocessing according to the present invention and the stapling unit 20 is adopted as the first postprocessing mechanism. Regardless of whether the postprocessing apparatus 10 is the basic postprocessing apparatus 10*a* which is selectively provided with the center-folding unit 50 or the function-added postprocessing apparatus 10*b* provided with the center-folding unit 50, the stapling processing which is a basic processing of the postprocessing can be performed to the recording sheet stack P1.

Further, in the above-described embodiment, the center-folding unit 50 is adopted as the second postprocessing mechanism according to the present invention. Accordingly, the bending processing of bending the stapled recording sheet into two-fold along a position at which the stapling processing is performed can be performed to the recording sheet stack P fed into the center-folding unit 50 through the stapling unit 20 in the state where the center-folding unit 50 is mounted in the housing 11.

The present invention is not limited to the above-described embodiment but includes the following matters.

In the above-described embodiment, the stapling processing performed in the stapling unit 20 to the recording sheet P is adopted as the first postprocessing according to the present invention and the center-folding processing performed in the center-folding unit 50 is adopted as the second postprocessing. The present invention is not limited to that the first postprocessing being the stapling processing and the second postprocessing being the center-folding processing. The first and second postprocessing can be set as various kinds of the postprocessing with respect to the recording sheet P. For example, an aligning processing of aligning the recording sheet stack P1 can be adopted as the first postprocessing, and the stapling processing of binding the aligned recording sheet stack P1 can be adopted as the second postprocessing.

In the above-described embodiment, the one which is provided with the end-binding stapler 38 on the side of the housing 11 i.e. the one adopting the stapler-separated type is exemplified and described. The present invention is not limited to the postprocessing apparatus 10 adopting the stapler-separated type but may be the one having the stapling unit 20 integrally provided with the stapler i.e. the integral type.

In the above-described embodiment, the pair of discharging rollers 21 are adopted as the conveyer according to the present invention. The present invention is not limited to that the conveying means is the pair of discharging rollers 21. The conveyer may be other member such as a conveying belt.

In the above-described embodiment, the driving force transmission mechanism 60 includes a complex structure having many gears, endless belts and the like. The present invention is not limited to the one adopting gears and endless belt in such combination as described above but may preferably adopt gears, endless belts and the like in the most appropriate combination in accordance with a size and specification of the postprocessing apparatus 10.

In the above-described embodiment, the driving force transmission mechanism which transmits the driving force of the driving motor 81 as a driver for an operation of the pressing member 53 of the center-folding unit 50 may be provided. Consequently, it becomes unnecessary to provide a separate driver for an operation of the pressing member 53 and contributes to a reduction of number of components and a manufacturing cost.

Further, the specific embodiment described above mainly includes the invention including the following construction.

A post processing apparatus according to one aspect of the present invention comprises: a housing to which a recording sheet is fed from a predetermined upstream device; a first postprocessing mechanism mounted in the housing and adapted for performing a predetermined first postprocessing to the recording sheet; a second postprocessing mechanism selectively mountable in the housing, and is provided with a predetermined driver, the second postprocessing mechanism being adapted for performing a predetermined second postprocessing to the recording sheet; a conveyance passage provided in the first postprocessing mechanism and adapted for conveying the recording sheet to the second postprocessing mechanism when the second postprocessing mechanism is mounted in the housing; and a conveying member provided in the conveyance passage and adapted for conveying the recording sheet, the conveying member being driven by a transmission of a driving force from the driver of the second postprocessing mechanism.

According to the construction, in the case where the second postprocessing mechanism for performing the second postprocessing which is the postprocessing other than the predetermined first postprocessing is not mounted in the housing, the postprocessing in the postprocessing apparatus is terminated after only the first postprocessing is performed to the recording sheet which is fed from the predetermined upstream device in the first postprocessing mechanism in the housing. On the other hand, in the case where the second postprocessing mechanism for performing the second postprocessing is selectively mounted in the housing and the processing by the second postprocessing mechanism is selected, the second postprocessing is performed to the recording sheet.

Further, the first postprocessing mechanism includes the conveyance passage for conveying the recording sheet to the second postprocessing mechanism, and the conveyance passage is provided with the conveying means. Accordingly, the recording sheet which is conveyed to the second postprocessing mechanism through the conveyance is assuredly and smoothly conveyed from the first postprocessing mechanism to the second postprocessing mechanism by a driving of the conveying means.

Such conveying member provided in the conveyance passage is driven by a transmission of a driving force from the driver provided in the second postprocessing mechanism. Accordingly, it would not be necessary to provide a transmission mechanism for transmitting a driving force from the driver to the first postprocessing mechanism. Consequently, since an unnecessary transmission mechanism which is not used does not exist in the first postprocessing mechanism in the case where the second postprocessing mechanism is not selectively mounted in the housing, it contributes to a reduction of the device cost. On the other hand, in the case where the second postprocessing mechanism is selectively mounted in the housing, a driving force from the driver provided in the second postprocessing mechanism is transmitted to the conveying member. Accordingly, the conveying member is driven without interference. Since it would not be necessary to provide an unnecessary driving force transmission mechanism on the side of the first postprocessing mechanism as described above, especially in the case where the second postprocessing mechanism is not selectively mounted in the housing, there exists no unnecessary transmission mechanism. Accordingly, it contributes to lower a cost of the postprocessing apparatus.

As the conveying member, a conveying roller for conveying the recording sheet in contact with a peripheral surface of the conveying roller to the second postprocessing mechanism with a rotation about an axis thereof can be used. By using conveying rollers, a conveying member can be made simple and the recording sheet can be assuredly conveyed to the second postprocessing mechanism.

In the above-described construction, it is preferable that the first postprocessing mechanism is provided with a first connecting gear, the second postprocessing mechanism is provided with a second connecting gear, and a driving force from the driver of the second postprocessing mechanism is transmitted to the conveying member through the first connecting gear and the second connecting gear engaged with each other when the second postprocessing mechanism is mounted in the housing.

According to the construction, a driving force from the driver provided in the second postprocessing mechanism in the state where the second postprocessing mechanism is mounted in the housing is transmitted to a conveying member provided in the first postprocessing mechanism through the second connecting gear and the first connecting gear engaged each other. Accordingly, the conveying member is driven by a driving of the driver provided in the second postprocessing mechanism and conveys the recording sheet from the first driving mechanism to the second postprocessing mechanism. Thus, a structure of the driving force transmitting mechanism of transmitting a drive force from the driver on the side of the second postprocessing mechanism is made simple, and an assured transmission of the driving force is secured.

It is preferable that the first postprocessing mechanism performs a stapling processing to a stack of recording sheets. According to the construction, since the postprocessing apparatus can perform the stapling processing to the recording sheet regardless of whether the second postprocessing mechanism as an option is mounted or not, a basic processing as the postprocessing can be performed to the recording sheet.

In this case, it is preferable that the second postprocessing mechanism includes a center-folding unit for performing a stapling processing to a stack of recording sheets at a central position in a longitudinal direction of the recording sheet, and performing a bending processing to the stapled recording sheets such that the stapled recording sheets bends into two-fold along a position at which the stapling processing is performed, and the driver is provided in the center-folding unit to perform the center-folding processing.

According to the construction, in the state where the second postprocessing mechanism is mounted in the housing, a bending processing is performed to the stapled recording sheets such that the recording sheets bends into two-fold along a position at which the stapling processing is performed. Since it is so constructed that a driving force from the driver is transmitted for the center-bending processing operation of the center-folding unit, the driver is saved and contributes to a reduction of a manufacturing cost.

According to the construction it is preferable that the first processing mechanism includes a stapling unit for performing a stapling processing to a stack of recording sheets, the second processing mechanism includes a center-folding unit for performing a bending processing to the stapled recording sheets in two-fold, the conveyance passage is provided in the stapling unit and adapted for conveying the recording sheet to the center-folding unit when the center-folding unit is mounted in the housing, and the conveying member includes a pair of conveying rollers which are provided in the conveyance passage for conveying the recording sheet to the center-folding unit, and are driven by a transmission of a driving force from a driving motor provided in the center-folding unit to thereby convey the recording sheet.

Further, an image forming system according to other aspect of the present invention comprises: the image forming apparatus for performing an image forming processing with respect to the recording sheet; and the postprocessing apparatus provided on downstream in the sheet conveyance direction with respect to the image forming apparatus and adapted for performing a predetermined postprocessing with respect to the recording sheet conveyed from the image forming apparatus, the postprocessing apparatus including: the housing including a reception opening for receiving a recording sheet which is fed from the image forming apparatus; the first postprocessing mechanism mounted in the housing and adapted for performing the predetermined first postprocessing to the recording sheet; the second postprocessing mechanism selectively mountable in the housing and including the predetermined driver, the second postprocessing mechanism being adapted for performing the predetermined second postprocessing to the recording sheet; the conveyance passage provided in the first postprocessing mechanism and adapted for conveying the recording sheet to the second postprocessing mechanism when the second postprocessing mechanism is mounted in the housing; and the conveying member provided in the conveyance passage and adapted for conveying the recording sheet, the conveying member being driven by a transmission of a driving force from the driver of the second postprocessing mechanism.

Furthermore, an image forming system according to other aspect of the present invention comprises: the image forming apparatus for performing an image forming processing with respect to a recording sheet; and the postprocessing apparatus provided on downstream in the sheet conveyance direction with respect to the image forming apparatus and adapted for performing a predetermined postprocessing with respect to the recording sheet conveyed from the image forming apparatus, the postprocessing apparatus including: the housing including a reception opening for receiving the recording sheet conveyed from the image forming apparatus; the stapling unit for performing the stapling processing to a stack of recording sheets; the center-folding unit selectively mountable in the housing and adapted for performing the bending processing to the stapled recording sheets in two-fold; the driver provided in the center-folding unit and adapted for performing an operation of the center-folding processing; the conveyance passage provided in the stapling unit and adapted for conveying the recording sheet to the center-folding unit when the center-folding unit is mounted in the housing; and the conveying member provided in the conveyance passage and driven by the driver to thereby convey the recording sheet.

According to the construction, the recording sheet after the image forming is performed is conveyed from the image forming apparatus to the postprocessing apparatus. In the case where the second postprocessing mechanism (center-folding unit) for performing the second postprocessing which is the postprocessing other than the predetermined first postprocessing to the recording sheet is not mounted in the housing, the postprocessing in the postprocessing apparatus is completed after only the first postprocessing is preformed in the first postprocessing mechanism (stapling unit) in the housing. On the other hand, in the case where the second postprocessing mechanism for performing the second postprocessing to the recording sheet is selectively mounted in the housing and the processing by the second postprocessing mechanism is selected, the second postprocessing is performed to the recording sheet.

Since the conveying member provided in the conveying passage is driven by a transmission of the driving force from the driver provided in the second postprocessing mechanism, there would be no need to provide in the first postprocessing mechanism a transmission mechanism for transmitting the driving force from the driver to the conveying means. Accordingly, since there exists no unnecessary transmission mechanism, it contributes to a reduction of an apparatus cost. On the contrary, in the case where the second postprocessing mechanism is provided in the housing selectively, the driving force from the driver provided in the second postprocessing mechanism is transmitted to the conveying means, the conveying means is driven without interference. Thus, in the case where the second postprocessing mechanism is not provided selectively on the housing, there is no unnecessary transmission mechanism. Accordingly, it contributes to a cost reduction of the image forming system.

This application is based on patent application No. 2005-330274 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A postprocessing apparatus comprising:

a housing to which at least one recording sheet is fed from a predetermined upstream device;

a first postprocessing mechanism mounted in the housing and adapted for performing a predetermined first postprocessing to the recording sheet;

a second postprocessing mechanism selectively mountable in or not mounted in the housing, and provided with a predetermined driver, the second postprocessing mechanism being adapted for performing a predetermined second postprocessing to the recording sheet;

a conveyance passage provided in the first postprocessing mechanism and configured to connect the first postprocessing mechanism to the second postprocessing mechanism so that the recording sheet is conveyed to the second postprocessing mechanism when the second postprocessing mechanism is mounted in the housing;

a conveying member provided in the conveyance passage and adapted for conveying the recording sheet; and a driving force transmission mechanism for selectively connecting the predetermined driver to the conveying member; wherein the conveying member is connected to the predetermined driver of the second postprocessing mechanism through the driving force transmission mechanism when the second postprocessing mechanism is mounted in the housing.

2. A postprocessing apparatus according to claim 1 wherein the conveying member includes a conveying roller for conveying the recording sheet in contact with a peripheral surface of the conveying roller to the second postprocessing mechanism with a rotation about an axis thereof.

3. A postprocessing apparatus according to claim 1, wherein:

the first postprocessing mechanism is provided with a first connecting gear, the second postprocessing mechanism is provided with a second connecting gear, and a driving force from the driver of the second postprocessing mechanism is transmitted to the conveying member through the first connecting gear and the second connecting gear engaged with each other when the second postprocessing mechanism is mounted in the housing.

4. A postprocessing apparatus according to claim 1, wherein the at least one recording sheet comprises a plurality of recording sheets and wherein the first postprocessing mechanism performs a stapling processing to a stack of recording sheets.

5. A postprocessing apparatus according to claim 1, wherein:

the at least one recording sheet comprises a plurality of recording sheets, the second postprocessing mechanism is a center-folding device including a center-binding unit for stapling a central portion of a stack of the recording sheets and a center-folding unit for bi-folding the stack of the recording sheets at the central portion, and the center-folding device includes the predetermined driver and;

the predetermined driver being operatively connected to the center-folding unit for driving the center-folding unit to bi-fold the stack of the recording sheets at the central portion.

6. A postprocessing apparatus according to claim 1, wherein:

the at least one recording sheet comprises a plurality of recording sheets, the first postprocessing mechanism includes a first stapling unit for stapling a stack of the recording sheets, the second postprocessing mechanism includes a second stapling unit for stapling a stack of the recording sheets and a center-folding unit for performing a bending processing to the stack of the recording sheets that have been stapled by the second stapling unit, the conveyance passage is provided in the first postprocessing mechanism and adapted for conveying the recording sheets to the second postprocessing mechanism when the second postprocessing mechanism is mounted in the housing, and the conveying member includes a pair of conveying rollers which are provided in the conveyance passage in the first postprocessing mechanism for conveying the recording sheet to the second postprocessing mechanism, and the conveying rollers being driven by a transmission of a driving force from a driving motor provided in the center-folding unit to thereby convey the recording sheets.

7. The postprocessing apparatus according to claim 6, wherein the second stapling unit is upstream of the center-folding unit in the second postprocessing mechanism.

8. The postprocessing apparatus according to claim 6, wherein the first stapling unit is disposed for stapling an end portion of the stack of the recording sheets, and wherein the second stapling unit is disposed for stapling a center portion of the stack of the recording sheets.

9. A postprocessing apparatus according to claim 1 further comprising a first tray communicating with the first postprocessing mechanism for receiving the recording sheet that has had the predetermined first postprocessing performed thereon and a second tray communicating with the second postprocessing mechanism for receiving the recording sheet that has had the second postprocessing performed thereon.

10. An image forming system comprising:

an image forming apparatus for performing an image forming processing with respect to at least one recording sheet; and a postprocessing apparatus provided downstream in a sheet conveyance direction with respect to the image forming apparatus and adapted for performing a predetermined postprocessing with respect to the recording sheet conveyed from the image forming apparatus, the postprocessing apparatus including:

a housing including a reception opening for receiving the recording sheet which is fed from the image forming apparatus;

a first postprocessing mechanism mounted in the housing and adapted for performing a predetermined first postprocessing to the recording sheet;

a second postprocessing mechanism selectively mounted in or not mounted in the housing and including a predetermined driver, the second postprocessing mechanism being adapted for performing a predetermined second postprocessing to the recording sheet;

a conveyance passage provided in the first postprocessing mechanism and configured to connect the first postprocessing mechanism to the second postprocessing mechanism so that the recording sheet is conveyed to the second postprocessing mechanism when the second postprocessing mechanism is mounted in the housing; and a conveying member provided in the conveyance passage and adapted for conveying the recording sheet; and a driving force transmission mechanism for selectively connecting the predetermined driver to the conveying member; wherein the conveying member is connected to the predetermined driver of the second postprocessing mechanism through the driving force transmission mechanism when the second postprocessing mechanism is mounted in the housing.

11. The image forming system according to claim 10, further comprising a first tray communicating with the first postprocessing mechanism for receiving the recording sheet that has had the predetermined first postprocessing performed thereon and a second tray communicating with the second postprocessing mechanism for receiving the recording sheet that has had the predetermined second close postprocessing performed thereon.

12. An image forming system comprising:

an image forming apparatus for performing an image forming processing with respect to recording sheets; and a postprocessing apparatus provided downstream in a sheet conveyance direction with respect to the image forming apparatus and adapted for performing a predetermined postprocessing with respect to the recording sheets conveyed from the image forming apparatus, the postprocessing apparatus including:

a housing including a reception opening for receiving the recording sheets conveyed from the image forming apparatus;

a stapling unit for performing stapling processing to a stack of the recording sheets;

a center-folding unit being selectively mounted in or not mounted in the housing and adapted for performing bending processing to the recording sheets in two-fold;

a driver provided in the center-folding unit and adapted for performing an operation of center-folding processing;

a conveyance passage provided in the stapling unit and configured to connect the stapling unit to the center-folding unit so that the recording sheet is conveyed to the center-folding unit when the center-folding unit is mounted in the housing; and a conveying member provided in the conveyance passage and adapted for conveying the recording sheet; and a driving force transmission mechanism for selectively connecting the driver to the conveying member; wherein the conveying member is connected to the driver through the driving force transmission mechanism when the center-folding unit is mounted in the housing.

13. The image forming system according to claim 12, wherein the center-folding unit includes a stapler for stapling a center portion of the stack of the recording sheets before performing the bending processing.

14. The image forming system according to claim 12, further comprising a first tray communicating with the stapling unit for receiving the stack of the recording sheets that have had the stapling processing performed thereon and a second tray communicating with the center-folding unit for receiving the recording sheets that have had the bending processing performed thereon.

* * * * *